US005366147A

United States Patent [19]

Morgan et al.

[11] Patent Number: 5,366,147

[45] Date of Patent: Nov. 22, 1994

[54] DELIVERY RECEPTACLE

[75] Inventors: John P. Morgan, Grand Rapids; Jack E. Hendricks, Allegan; Kurt Post, Zeeland, all of Mich.

[73] Assignee: Flashes Publishers, Inc., Allegan, Mich.

[21] Appl. No.: 12,018

[22] Filed: Feb. 1, 1993

[51] Int. Cl.[5] ..... B65D 91/00

[52] U.S. Cl. ..... 232/1 C; 232/29; 232/33; D99/33

[58] Field of Search ..... 232/1 C, 1 A, 29, 38, 232/33; D99/29, 33, 32

[56] References Cited

U.S. PATENT DOCUMENTS

| | | | |
|---|---|---|---|
| D. 70,586 | 7/1926 | Swanson | D99/33 |
| D. 84,371 | 6/1931 | Reimer | D99/33 |
| D. 177,213 | 3/1956 | Bucci | D99/33 |
| D. 184,051 | 12/1958 | Grafton | D99/33 |
| D. 218,490 | 8/1970 | Blumberg | D99/33 |
| 99,489 | 2/1870 | Dexter . | |
| 989,727 | 6/1908 | Siegfried | 232/1 C |
| 1,654,364 | 12/1927 | Crimmel | 232/1 C |
| 1,656,426 | 1/1923 | Cunningham . | |
| 3,277,291 | 10/1966 | Holbrook . | |
| 3,996,649 | 12/1976 | Podd . | |
| 4,821,988 | 4/1989 | Jiminez . | |
| 4,961,556 | 10/1990 | Sosa . | |
| 5,020,755 | 6/1991 | Frankel . | |

*Primary Examiner*—Michael J. Milano

*Attorney, Agent, or Firm*—Price, Heneveld, Cooper, DeWitt & Litton

[57] ABSTRACT

A delivery tube includes a body portion defining an interior space or cavity for receiving a first delivered item; a hanger having at least one position and being integrally molded in one piece with the body for receiving a second delivered item other than in the interior cavity or space; and a mount integrally formed in one piece with the body whereby the receptacle is mounted to a support.

12 Claims, 2 Drawing Sheets

DELIVERY RECEPTACLE

BACKGROUND OF THE INVENTION

The present invention relates to delivery receptacles. Typical examples of delivery receptacles include, but are not limited to, mailboxes and newspaper boxes and the like.

With ever-increasing postal rates, magazine and advertising publishers or distributors and the like commonly use private contract delivery services for distribution of advertisements and subscription publications. One of the most convenient repositories for those delivering and those receiving such materials is at the mailbox post as evidenced by the long-standing tradition of newspaper distributors fastening a paper box to a subscriber's mailbox post for delivery and receipt of the subscribed newspaper. However, a mailbox or paperbox is generally unavailable for delivery and receipt of materials other than official United States mail or a subscribed paper.

Thus, those delivering other materials devise alternative means for delivery and receipt of their materials. In the case of a wooden mailbox post, delivery services typically use a screw hook or otherwise screw fasten a hook device to a portion of the post for delivery of materials in a bag which is hung on the hook. In the case of a steel mailbox post or the like, however, it is generally impractical to drill and tap the steel structure for a screw hook device.

Further, in those situations where a screw hook may be installed on a wooden mailbox post, the screw hook used is typically an inexpensive, light duty member, subject to damage or failure. Such screw hooks may fail and become hazardous or simply degrade the overall appearance of the mailbox post.

SUMMARY OF THE INVENTION

The present invention effectively addresses the problems identified above with a durable delivery receptacle which is relatively easy and inexpensive to mass produce.

A delivery receptacle according to the present invention includes a body defining an interior cavity or space in which a first delivered item is releasably received and held. A mount is integrally formed in one piece with the body for mounting the receptacle to a support surface. A hanger is also integrally molded in one piece with the body for releasably receiving and supporting a second delivered item other than in the interior cavity or space.

In one aspect of the invention, the receptacle may be mounted to support surfaces having various orientations, including generally vertical and generally horizontal, for example. Further, the hanger has at least two positions for receiving and supporting the second delivered item.

These and other objects, advantages, and features of the present invention will become apparent upon review of the following specification in conjunction with the drawings.

DESCRIPTION OF THE PREFERRED EMBODIMENTS

Figure 1:
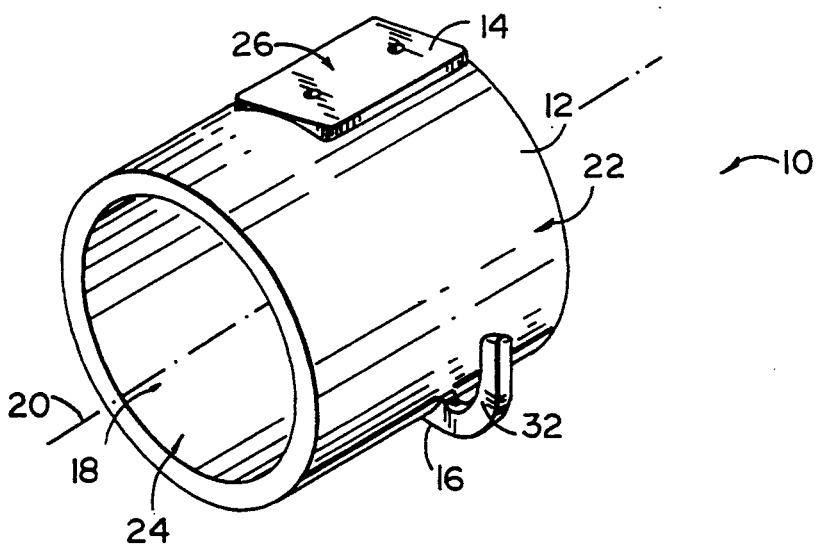
FIG. 1 is a perspective view of a delivery receptacle according to the present invention.
Figure 2:
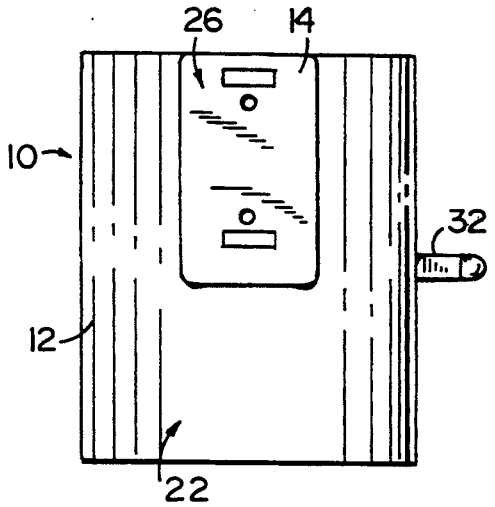
FIG. 2 is a top plan view thereof.

Referring to the drawings in greater detail, a delivery receptacle 10 according to the present invention includes a body 12, a mount 14, and a hanger 16 integrally molded in one piece (FIGS. 1–5).

Figure 3:
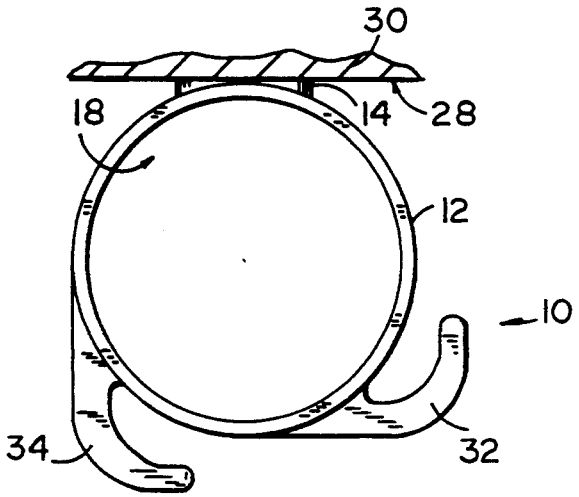
FIG. 3 is a front elevational view thereof.

Body 12 defines an interior cavity or space 18 in which a delivered item is releasably received and held (FIGS. 1 and 3). Body 12 extends along a longitudinal axis 20 (FIG. 1) and has an exterior surface 22 (FIGS. 1–5). Further, an opening 24 through which the delivered item is received by and removed from the interior cavity or space 18 is most preferably provided at one end of body 12 (FIG. 1). Body 12 is most preferably a tubular member and while the embodiment shown specifically has a circular cross section, it will become apparent to those who practice the invention that a variety of tubular shapes with various cross sections may be used within the scope of this invention with equivalently good result. However, it is noted that a tubular member having a generally circular cross-sectional shape provides one of the strongest geometries for the structure.

Mount 14 most preferably defines a generally planar surface 26 which projects at least slightly from exterior surface 22 of body 12 (FIGS. 1–3*a*). Mount 14 thus provides surface 22 for abutting and attachment to a mounting surface 28, 28′ of a support 30, 30′. Mounting surface 28, 28′ will typically be either generally horizontally or generally vertically oriented, respectively, but may also have some other orientation.

Figure 3A:
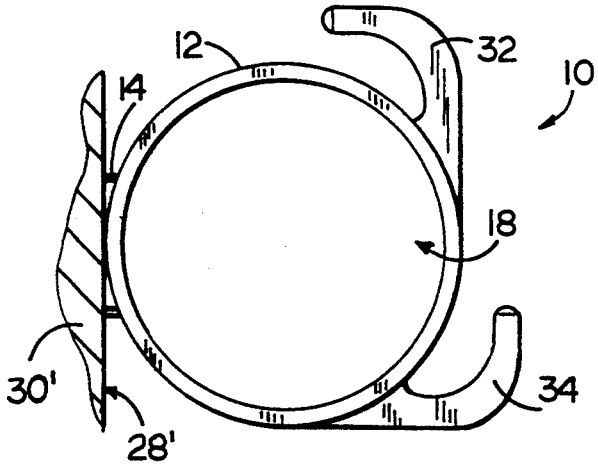
FIG. 3*a* is the view of FIG. 3, showing the delivery receptacle in an alternative mounting orientation.
Figure 4:
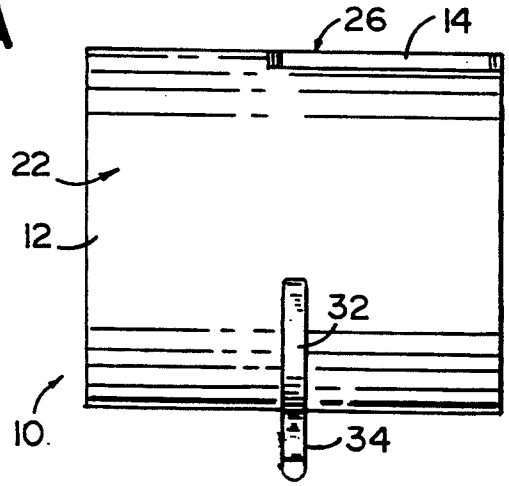
FIG. 4 is a right side elevational view thereof.
Figure 5:
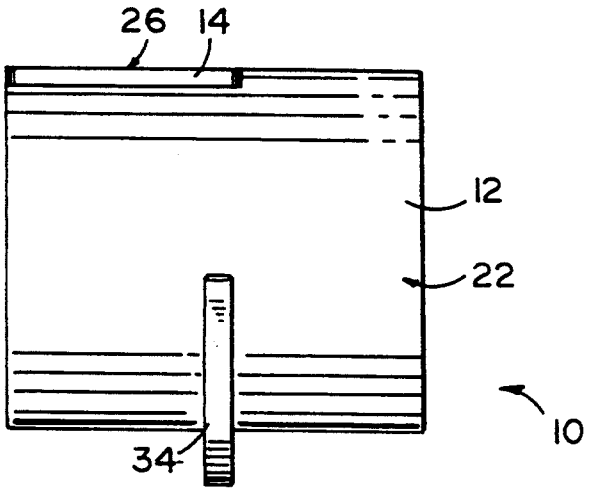
FIG. 5 is a left side elevational view thereof.

As may be most clearly seen in FIGS. 3 and 3*a*, hanger 16 may be a pair of hooks 32 and 34, extending generally outward from exterior surface 22 of body 12. Hooks 32 and 34 are most preferably spaced from one another by about 90 degrees of rotation relative to axis 20 so that one hook 32 may receive and support a delivered item when receptacle 10 is mounted to a generally horizontal surface 28 (FIG. 3) and the other hook 34 may receive and support a delivered item when receptacle 10 is mounted to a generally vertical surface 28′ (FIG. 3*a*). Thus, one hook 32 is positioned on body 12 generally opposite mount 14 with the other hook 34 positioned on body 12 between hook 32 and mount 14.

Delivery receptacle 10 is easily and inexpensively molded in one piece. A moldable material such as polypropelene or other suitable plastic may be injected into and fill spaces or regions of a cavity defined by a mold whereby body 12, mount 14, and hanger 16 are formed and molded in one piece. As the moldable material cures, that is cools, hardens, and sets up, it becomes a tough and resilient mass defining each of body 12, mount 14, and hanger 16 in one piece.

The above description is considered that of the preferred embodiments only. Modifications to the invention, including but not limited to those mentioned above, will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A delivery receptacle comprising a body defining an interior cavity wherein a first item delivered to said receptacle is releasably received and held, said cavity opening through one of two opposing ends of said body; said body having an exterior surface, said exterior surface having a portion defining a mount integrally formed in one piece with said body, whereby said receptacle is mounted to support surface, said mount having a mounting surface; said body having a first hanger integrally formed in one piece with said body, said first hanger extending generally radially outward from said exterior surface in a direction about parallel with said mounting surface; said body also having a second hanger integrally formed in one piece with said body, said second hanger extending generally radially outward from said exterior surface in a direction about perpendicular to said mounting surface, whereby a second item delivered to said receptacle is releasably received and held.

2. The receptacle defined in claim 1 wherein said body is generally cylindrical.

3. The receptacle defined in claim 1 wherein said mounting surface is generally planar and offset to project from said exterior surface of said body.

4. The receptacle defined in claim 1 wherein said first hanger includes a hook extending generally outward from said exterior surface of said body.

5. The receptacle defined in claim 4 wherein said second hanger includes a second hook, said second hook being spaced circumferentially about said body less than about 180 degrees of rotation from said first hook.

6. A delivery receptacle comprising:

a tubular body defining an interior space, said interior space having an opening through one of two opposing ends of said body whereby a first item delivered to said receptacle is received by and removed from said interior space through said opening, said body having an exterior surface;

a generally planar surface on said exterior surface defining a mount whereby said receptacle is mounted to a support surface, said mount being formed in one piece with said body; and a hanger integrally formed in one piece with said body and extending generally radially outward from said exterior surface, whereby a second item delivered to said receptacle is releasably received and held, said hanger having a first position spaced circumferentially about said body less than about 180 degrees of rotation from said mount, said hanger having a second position spaced circumferentially about said body about 90 degrees of rotation from said first position.

7. The receptacle defined in claim 6 wherein said generally planar surface projects from said exterior surface of said body.

8. The receptacle defined in claim 6 wherein said hanger includes a first hook located at said first position and a second hook located at said second position.

9. The receptacle defined in claim 6 wherein said first position is located about opposite said generally planar surface and said second position is located between said first position and said generally planar surface.

10. The receptacle defined in claim 9 wherein said hanger includes a first hook located at said first position and a second hook located at said second position.

11. The receptacle defined in claim 10 wherein each said hook extends generally outward from said exterior surface.

12. The receptacle defined in claim 8 wherein each said hook extends generally outward from said exterior surface.

* * * * *

UNITED STATES PATENT AND TRADEMARK OFFICE

CERTIFICATE OF CORRECTION

PATENT NO. : 5,366,147

DATED : November 22, 1994

INVENTOR(S) : John P. Morgan et al.

It is certified that error appears in the above-indentified patent and that said Letters Patent is hereby corrected as shown below:

Column 3, line 13:
"to support" should be --to a support--.

Signed and Sealed this

Eleventh Day of April, 1995

*Attest:*

Bruce Lehman

BRUCE LEHMAN

*Attesting Officer*

*Commissioner of Patents and Trademarks*